United States Patent [19]

Chiou

[11] Patent Number: 4,869,425

[45] Date of Patent: Sep. 26, 1989

[54] LETTER BOX

[76] Inventor: Chuang-Jiunn Chiou, No. 12, Alley 18, Fu Ren Street, Taichung City, Taiwan

[21] Appl. No.: 230,566

[22] Filed: Aug. 10, 1988

[51] Int. Cl.[4] ..... B65D 91/00

[52] U.S. Cl. ..... 232/17; 232/19; 232/34

[58] Field of Search ..... 232/17, 34, 19, 37

[56] References Cited

U.S. PATENT DOCUMENTS

| | | | |
|---|---|---|---|
| 1,020,194 | 3/1912 | Field | 232/19 |
| 1,538,871 | 5/1925 | Krick | 232/19 |
| 2,467,475 | 4/1949 | Hallamore | 232/19 X |
| 2,477,379 | 7/1949 | Korth | 232/34 |
| 3,620,444 | 11/1971 | Crozier | 232/37 X |

FOREIGN PATENT DOCUMENTS

| | | | |
|---|---|---|---|
| 17229 | 11/1927 | Netherlands | 232/37 |

*Primary Examiner*—Robert W. Gibson, Jr.
*Attorney, Agent, or Firm*—McGlew & Tuttle

[57] ABSTRACT

A letter box includes a housing having a pivotable door having a letter inlet and an inlet cover pivotably covering the inlet, and an indicating device coupled to the inlet cover in the manner that when a letter is inserted from the inlet into the box the device will be actuated to indicated that there is a letter in the box.

8 Claims, 3 Drawing Sheets

LETTER BOX

BACKGROUND OF THE INVENTION

The present invention relates to a container, and more particularly to a letter box.

The door of the conventional letter box is normally provided at the lower half portion thereof with a rectangular window covered by a transparent glass or acrylic plate for inspecting whether there is a letter in the box in order to prevent the user from unlocking the door in vain. Such box, however, can find the following disadvantages:

1. If the window is too small, the user cannot always ascertain whether there is a letter in the box without failure by merely inspecting the box through the window.

2. If the window is too large, the box will no longer safely store therein a letter if the acrylic plate were destroyed whether intentionally or not.

It is therefore tried by the Applicant to deal with the above situation encountered by the prior art.

SUMMARY OF THE INVENTION

It is therefore an object of the present invention to provide a letter box having an indicating device capable of indicating whether there is a letter in the box without failure.

According to the present invention, a letter box includes a housing having a pivotable door having a letter inlet and an inlet cover pivotably covering the inlet, and an indicating means coupled to the inlet cover in the manner that when a letter is inserted from the inlet into the box the device will be actuated to indicate that there is a letter in the box.

The indicating means can include a peephole, a slidable indicating piece having a marked lower portion capable of being seen from the peephole, an actuating medium coupled between the indicating piece and the inlet cover, and a stopping member having a stopping piece capable of stopping the indicating piece from downwardly falling after the indicating piece has been upwardly slid.

The present invention may best be understood through the following description with reference to the accompanying drawings, in which:

DETAILED DESCRIPTION OF THE PREFERRED EMBODIMENT

Figure 2:
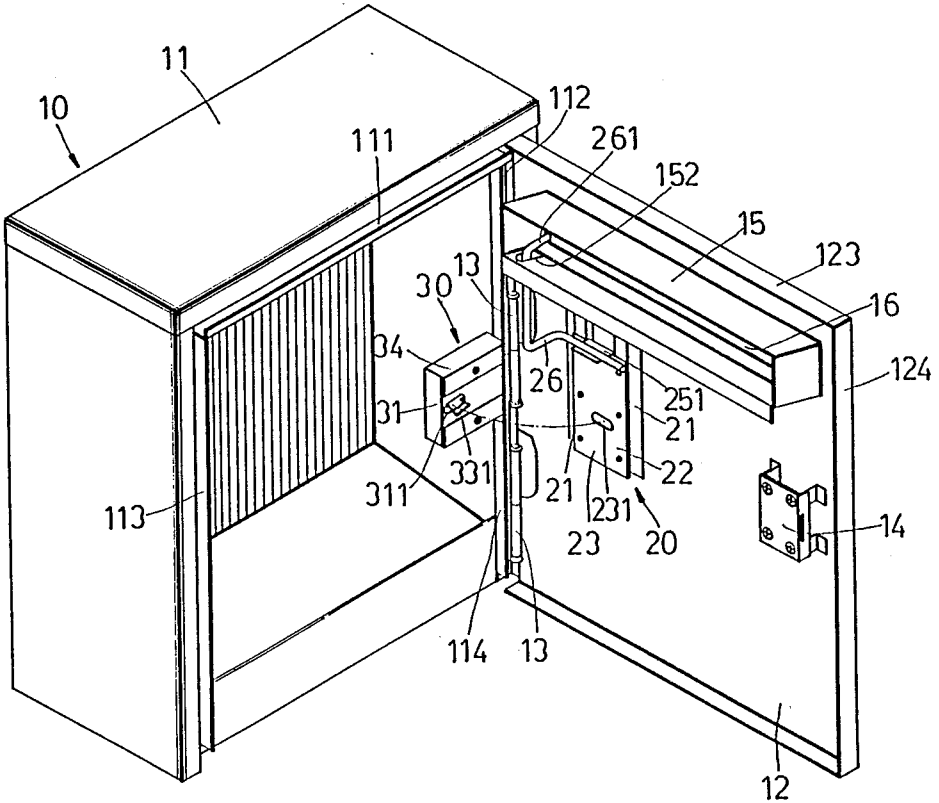
FIG. 2 is a perspective view of a letter box in FIG. 1 with the door been opened.
Figure 1:
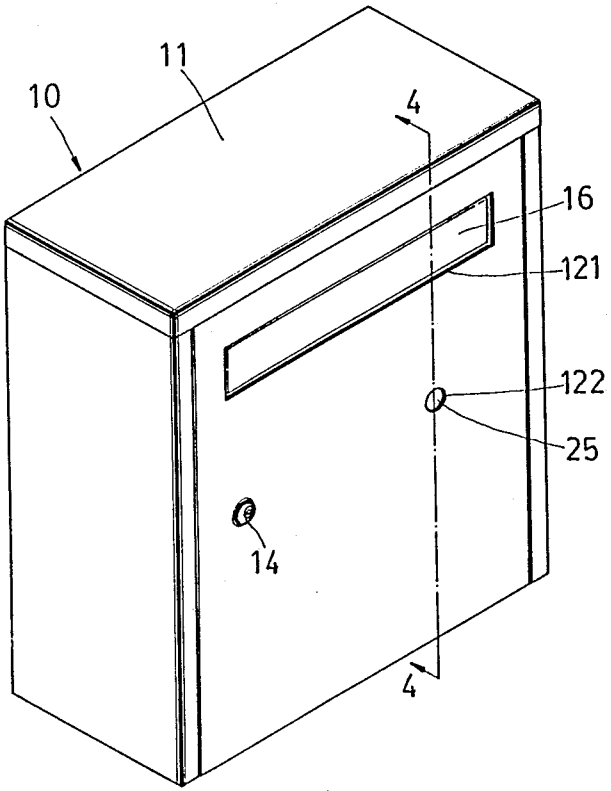
FIG. 1 is a perspective view showing a preferred embodiment of a letter box according to the present invention.
Figure 3:
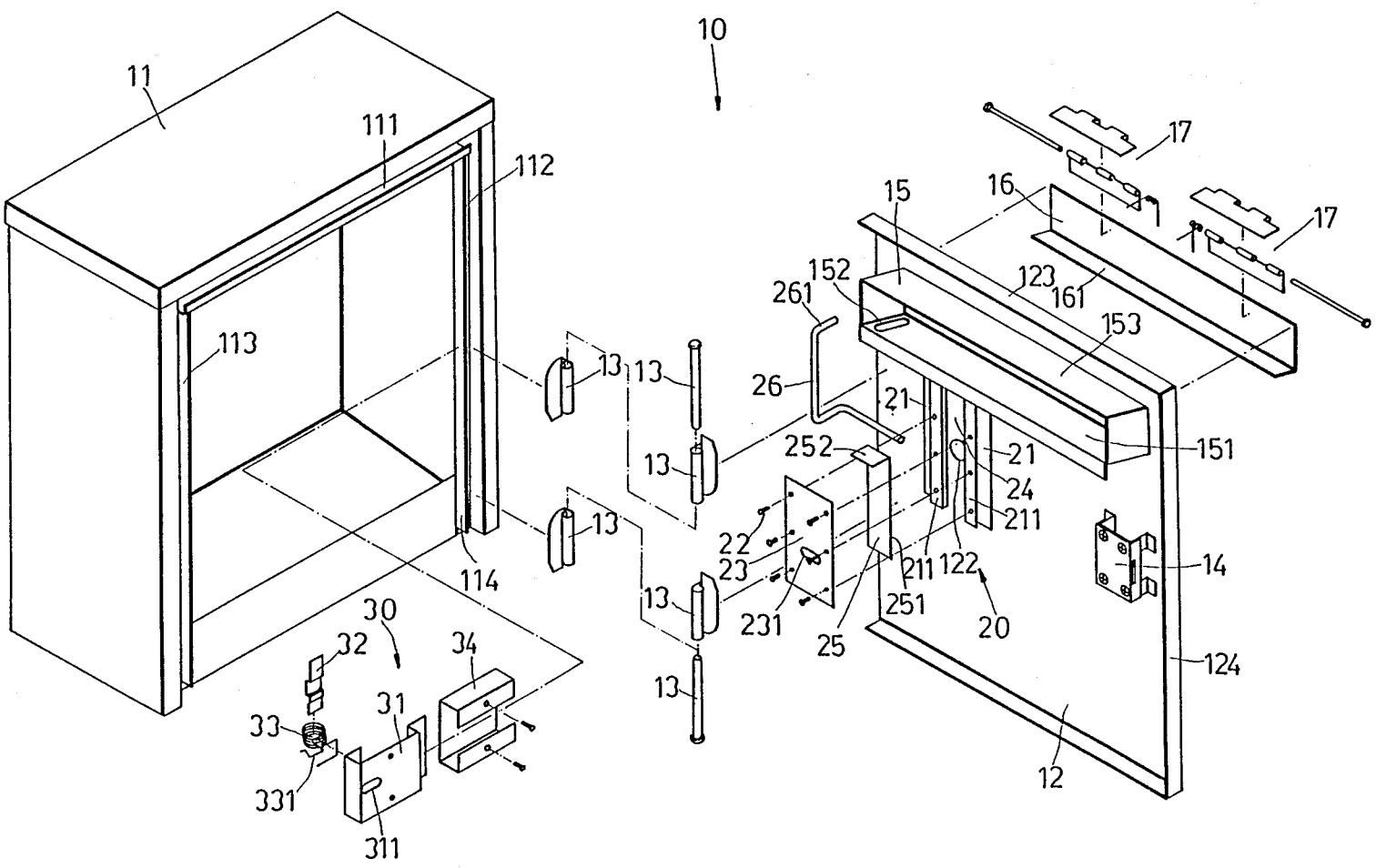
FIG. 3 is an exploded view of a letter box in FIG. 2.

Referring now to FIGS. 1–6, the present letter box 10 includes a housing 11 and an indicating means (20, 30). Housing 11 has an opening side including a top water-receiving groove 111 and two side water-guiding grooves 112, 113, and a door 12 which has the right side thereof pivotably connected to housing 11 by two hinges 13 and includes a lock device 14 at the left portion, a letter inlet 121, a peephole 122, an inlet extension 15 inwardly extending from inlet 121 to form a letter passage and including a bottom wall 151 having a side slot 152 and a top wall 153, an inlet cover 16 pivotably connected to top wall 153 by two hinges 17 for covering inlet 121 and having a hooking bottom 161, and a top flange 123 and a side flang 124 which are respectively inserted into grooves 111, 113 when door 12 is closed on housing 11 for better guaranteeing a water-preventing effect of the box 10.

Indicating means includes an indicating device 20 and a stopping method 30. Indicating device 20 includes two parallel guiding rails 21 respectively having raised surfaces 211 attaching thereto a cover plate 23 by bolts 22, a sliding groove 24 constituted by rails 21 and plate 23 having a slot 231, an indicating piece 25 slidable in sliding groove 24 and having a differently colored lower portion 251 and a bent top 252 resting on the top end of cover plate 23, and an actuating medium 26 having a first end fixed to bent top 252 and a second end 261 penetrating through side slot 152 to be capable of being actuated by hooking bottom 161 when a letter is inserted from letter inlet 121 into box 10 to upwardly slide indicating piece 25 to present colored lower portion 251 right behind peephole 122 to indicate that there is a letter in box 10.

Stopping member 30 secured to a right flange 114 of housing 11 includes a plate body 31 having a slot 311, a securing piece 32 confining therein a torsional spring 33 having a first end engaging with plate body 31 and a second end 331 passing through slot 311 to serve as a stopping piece penetrating through slot 231 for capable of forwardly moving to stop indicating piece 25 from downwardly falling after indicating piece 25 has been upwardly slid through the inserting of a letter in box 10 from inlet 121, and a casing 34 housing therein plate body 31, securing piece 32 and torsional spring 33.

Figure 6:
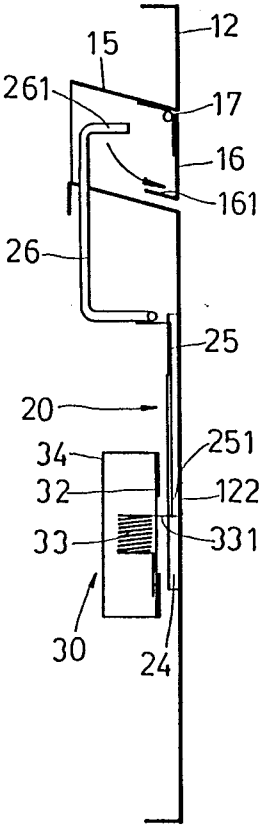
FIG. 6 is similar to FIG. 4, showing the state of the present letter box after a letter has been inserted therein.
Figure 5:
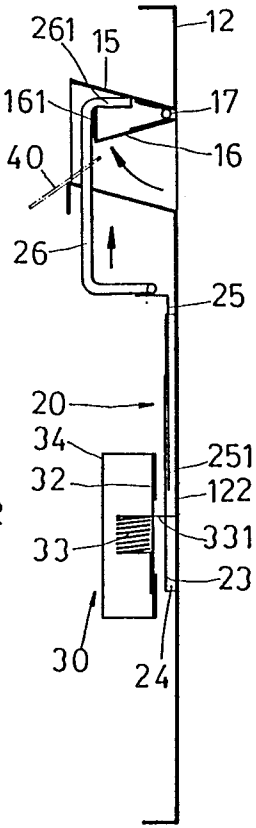
FIG. 5 is similar to FIG. 4, showing the state of the present letter box upon inserting therein a letter.
Figure 4:
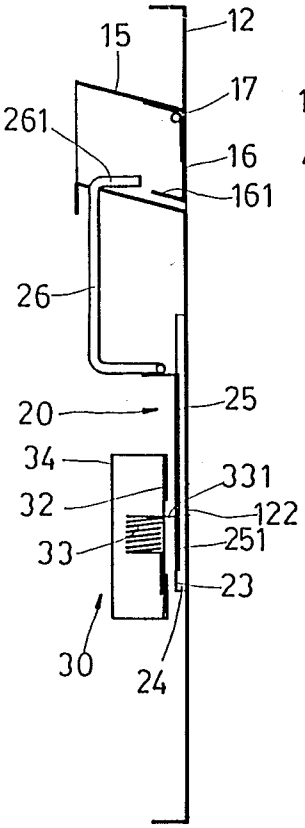
FIG. 4 is a sectional view taken along line 4–4 in FIG. 1.

FIG. 4 shows that bent top 252 rests on the top end of cover plate and stopping piece 331 urges against indicating piece 25. FIG. 5 shows the state of the present box 10 upon a letter 40 being inserted therein through inlet 121 that hooking bottom 161 upwardly slides indicating piece 25 above stopping piece 331 having forwardly protruded into sliding groove 24. FIG. 6 shows the state of the present box 10 after letter 40 has passed through letter passage 15 into box 10 that indicating piece 25 slightly downwardly falls to be supported by stopping piece 331 to present colored lower portion 251 right behind peephole 122. When the user opens door 12 to take letter 40 out from box 10, indicating piece 25 will fully fall down to the state shown in FIG. 4.

Figure 7:
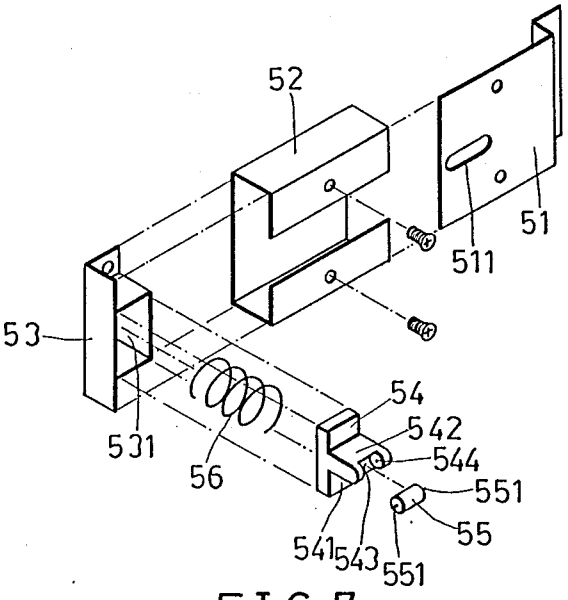
FIG. 7 is an exploded view showing a second preferred embodiment of a stopping member used in a letter box in FIG. 1.
Figure 8:
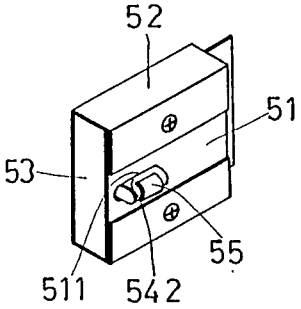
FIG. 8 is an assembled view showing a stopping member in FIG. 7.

As shown in FIGS. 7 & 8, there is shown a further embodiment of the stopping member according to the present invention. The stopping member includes a plate body 51 secured to housing 11 and having a slot 511, a casing 52 receiving therein plate body 51, a base received in casing 52 and having a receiving room 53, a T-shaped stopping piece 54 which is received in receiving room 53 and includes a vertical plate 541 and a horizontal plate 542 having a tip indentation 543 having two small side holes 544 respectively mounting therein two shaft ends 551 of a roller 55, and an elastic member 56 mounted between base 53 and stopping piece 54 for urging stopping piece 54, through slot 511 and slot 231, against indicating piece as the manner shown in FIG. 4.

Through the above description, it should now become readily apparent how and why the present invention can achieve the object it contemplates.

What I claim is:

1. A letter box comprising: a housing having an opening side and a pivotal door having a letter inlet and an inlet cover pivotably covering said inlet; an indicating means coupled to said inlet cover in a manner that when a letter is inserted from said letter inlet into said box, said means will be actuated to indicate that there is a letter in said box, said indicating means including: a peephole provided on said door; an indicating piece having a first surface vertically slidable on an inner surface of said door and having a marked lower portion capable of being seen from said peephole; an actuating medium having a first end connected to said indicating piece and a second end capable of being actuated by said inlet cover to upwardly slide said indicating piece to present said lower portion right behind said peephole; and a stopping member secured to said housing and having a stopping piece capable of stopping said indicating piece from downwardly falling after said indicating piece has been upwardly slid.

2. A letter box according to claim 1, further comprising a sliding groove sliding therein said indicating piece and constituted by two parallel guiding rails fixed to said inner surface and a cover plate which is secured to said guiding rails and has a first slot passing therethrough said stopping piece to engage with said indicating piece.

3. A letter box according to claim 1 wherein said stopping member includes:

a plate body secured to said housing and having a second slot; and a torsional spring having a first end engaging with said plate body and a second end passing through said second slot to serve as said stopping piece.

4. A letter box according to claim 3, further comprising a casing receiving therein said plate body and said torsional spring.

5. A letter box according to claim 1 wherein said stopping member includes:

a plate body secured to said housing and having a second slot;

a casing receiving therein said plate body;

a base received in said casing and having a receiving room receiving therein said stopping piece protruding through said second and first slots; and an elastic member mounted between said base and said stopping piece for urging said stopping piece against said indicating piece.

6. A letter box according to claim 5 wherein said stopping piece is a T-shaped piece having a tip portion thereof attached thereto a roller.

7. A letter box according to claim 1, further comprising an inlet extension inwardly extending from said letter inlet and including a top wall pivotably mounted thereunder said inlet cover and a bottom wall having a side slot passing therethrough said second end.

8. A letter box according to claim 1 wherein:

said opening side includes a top water-receiving groove and two side water-guiding grooves; and said door includes a top flange and a side flange provided on a side opposite to the side pivoted to said housing, for a water-preventing purpose.

* * * * *